United States Patent [19]

Weisman

[11] 3,974,841

[45] Aug. 17, 1976

[54] COMBINED COMB AND HAIR ROLLER SUPPORT

[76] Inventor: Harry Daniel Weisman, 9372 Portsmount Drive, Huntington Beach, Calif. 92646

[22] Filed: Aug. 22, 1975

[21] Appl. No.: 606,753

[52] U.S. Cl. ..... 132/40; 132/9

[51] Int. Cl.[2] ..... A45D 2/00

[58] Field of Search ..... 132/40, 42, 33, 9, 41

[56] References Cited

UNITED STATES PATENTS

| | | | |
|---|---|---|---|
| 2,452,814 | 11/1948 | Wagle | 132/46 A |
| 3,073,318 | 1/1963 | Catania | 132/41 |

*Primary Examiner*—G.E. McNeill

*Attorney, Agent, or Firm*—William C. Babcock

[57] ABSTRACT

A one-piece device formed from a rigid but deformable polymerized resin that may be selectively used as a comb on a woman's hair during drying of the latter in a stream of warmed air or as a support for a cylindrical hair roller shell that has at least one row of longitudinally spaced opening formed therein and about which shell the hair may be wound at a desired stage in the drying operation. The invention provides a beautician with a single device to not only comb the hair, but roll the hair on a cylindrical shell.

6 Claims, 5 Drawing Figures

A
B
C
D
E
E-1
10
12
14
14a
16
18
20
20a
20b
22
24
26
28
30
30a
32
34
36
38
38a
40
42
44
46

COMBINED COMB AND HAIR ROLLER SUPPORT

BACKGROUND OF THE INVENTION

1. Field of the Invention

Combined comb and hair roller support.

2. Description of the Prior Art

In the present day beauty shops, a woman's hair after shampooing is dried in a stream of warmed air. To facilitate the drying of the hair, the invention may be used to comb the air as the latter is being dried in a stream of warmed air. At a particular stage in the drying operation, the invention may also be used to removably support a cylindrical shell, commonly referred to as a roller, to have the hair wound thereon. The present invention has the operational advantage that it serves the dual function of providing means for combing the hair and sequentially supporting the shells or rollers in positions to have the partially dried hair wound thereon.

A major object of the present invention is to provide a device having the above mentioned operational advantages that is formed from a single molded elongate body of a polymerized resilient resin, and with the body being deformable to define a handle, which handle supports a combination of elements that include teeth for combing the hair, and the combination being adapted to removably gripping a cylindrical roller on which hair may be wound.

A still further object of the invention is to provide a preformed molded bland that may be deformed to provide a single device that not only serves as a comb, but as a removable support for a cylindrical shell on which hair may be wound.

SUMMARY OF THE INVENTION

The invention is adapted to be used selectively either as a comb or as a support for a roller in the form of a cylindrical shell on which hair may be wound. The shell has at least one row of longitudinally spaced openings formed therein. The device is formed from an elongate body of a polymerized resilient resin that includes an arcuate intermediate section that has first and second ends. The device is formed from an elongate body of a polymerized resilient resin that includes an arcuate intermediate section that has first and second ends and first and second elongate sections projecting from the first and second ends.

The first section includes a first elongate handle portion adjacent the first end, with the first handle portion having a first extremity. A leg is provided that extends outwardly at an angle from the first extremity, with the leg having an elongate longitudinally extending slot formed therein. The leg has a first outer end. A first elongate member extends outwardly from the first outer end, with the first member having a number of longitudinally spaced apertures formed therein that are on the same spacing as the openings formed in the cylindrical shell.

An angularly disposed tang is supported from the free end of the first member. The second section includes a second handle portion adjacent the second end of the intermediate portion, which second handle portion has a first extremity. A rod projects from the first extremity of the second handle portion. A second elongate member is supported by the rod.

A number of teeth are provided that project outwardly from the second member and are on the same longitudinal spacing as the apertures and extend outwardly therethrough when the body is deformed to dispose the rod in the slot, with the first and second handle portions being substantially parallel to one another, and the first member overlying the second member. When the device is so disposed, it is adapted to be used as a comb. The device is also adapted to removably support a cylindrical shell when the latter is gripped between the first and second member, with the teeth projecting through the openings in the shell, and a tang supported from the free end of the first member being in pressure contact with the interior surface of the shell to removably hold the shell in a first position on the device.

DESCRIPTION OF THE PREFERRED EMBODIMENT

Figures 1, 2, 3, 4, 5:
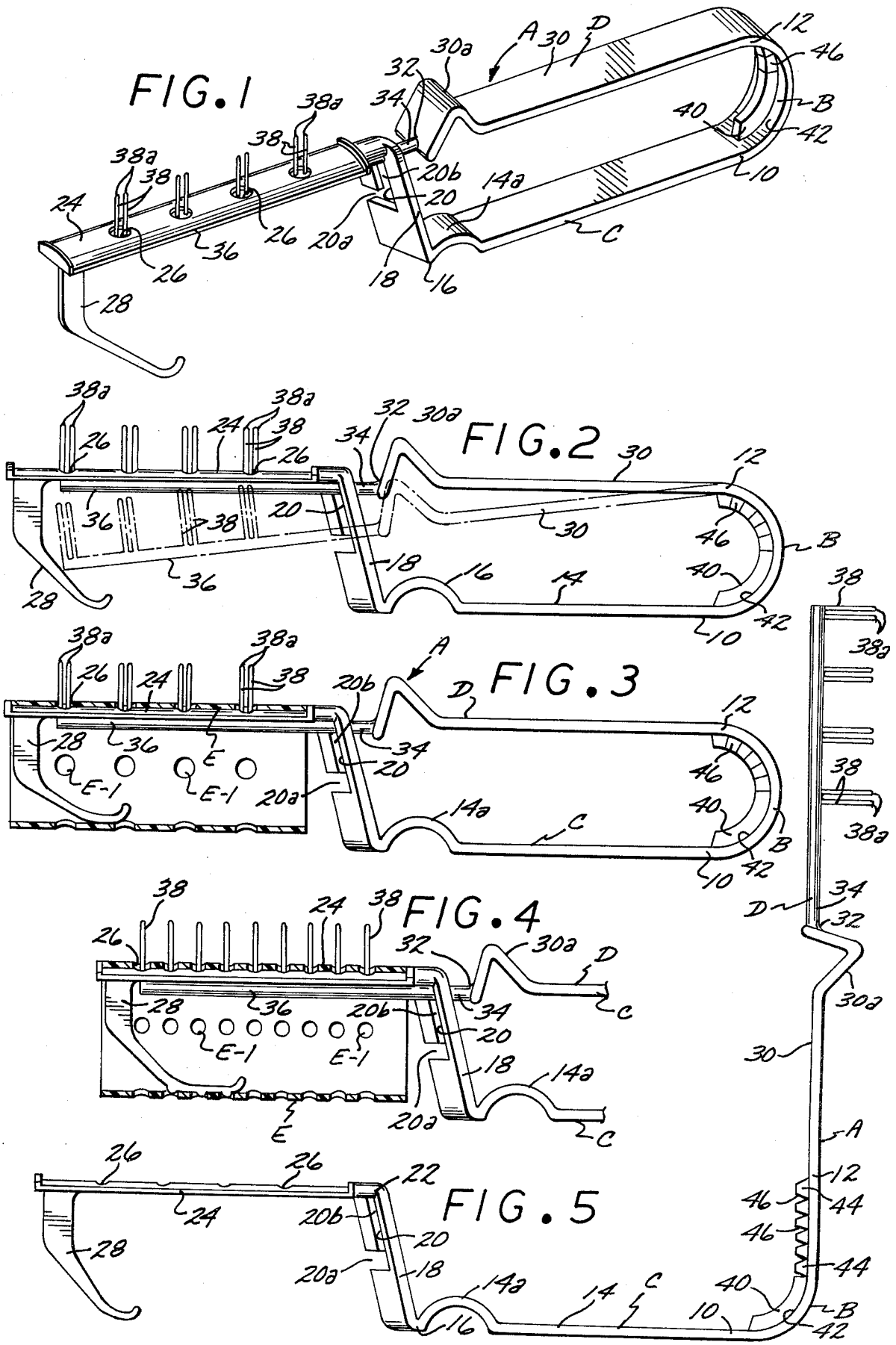
FIG. 1 is a perspective view of the first form of a combined comb and support for a hair roller.
FIG. 2 is a side elevational view of the device in which it is shown in a first position in solid line, and a second position shown in phantom line.
FIG. 3 is the same elevational view as shown in FIG. 2 but with the device removably supporting a hair roller of conventional design that is in the form of a cylindrical shell that has at least one row of longitudinally spaced openings formed therein.
FIG. 4 is a partial side elevational view of the first alternate form of the device, with the device shown in the first position.
FIG. 5 is a side elevational view of the molded blank that may be deformed to define the device illustrated in FIG. 1.

The first form of the hair dressing device A, shown in FIGS. 1–3 inclusive, may be used selectively either as a comb during the drying of a woman's hair, or as support for a roller E, to half strands of the hair wound thereon. The roller E is of present day conventional design and includes a cylindrical shell in which at least one row of longitudinally spaced openings E-1 are formed. If desired, the openings E-1 may be replaced by a longitudinal slot.

The device A is of one-piece construction and is formed by deforming the molded blank A′ shown in FIG. 5. Blank A′ is molded by conventional present day means, with the blank being formed from a pulverized resin that while rigid, is resilient and may be deformed. Pulverized resins suitable for the above purpose are polyethelese, polypropylene, and the like. The blank A′ as may best be seen in FIG. 5, includes an arcuate intermediate section B, a first elongate section C, and a second elongate section D.

The intermediate section B has a first end 10 and second end 12. The first end 10 merges into a first elongate handle portion 14 which has an outer end section 16 that is preferably of convex-concave shape. A leg 18 extends outwardly, preferably at an angle from the section 16, with the leg having a longitudinal slot 20 formed therein. The leg 18 has a first outer end 22 from which an elongate member 24 extends, which member 24 has a number of longitudinal spaced apertures 26 formed therein. The free end of the first elongate member 24 supports a tang 28 that extends downwardly and inwardly towards the leg 20, as can be seen in both FIGS. 1 and 5.

The second section D, includes a second handle portion 30 that extends outwardly from the second end 12, and the handle portion 30 preferably includes a protuberance 30*a* adjacent the first extremity thereof. A rod 34 extends outwardly from first extremity 30*a*, with the rod supporting a second elongate member 36. The second elongate member 36, as may best be seen in FIGS. 1, 2 and 5, supports a number of longitudinally spaced teeth 38. The teeth 38, as shown in the first form A of the invention, are each defined by at least two parallel elements 38*a* adjacently disposed but spaced from one another. The spacing of the teeth elements 38*a* from one another is to provide maximum contact of the teeth elements with a woman's hair (not shown) in the combing of the latter.

The intermediate section B, as may best be seen in FIG. 5, is molded to have a first arcuate reinforcing member 40 formed on a surface 42 thereof. Second reinforcing lugs 44 also extend outwardly from the surface 42, with the lugs 44 being separated from one another by V-shaped spaces 46.

The first form A of the device is provided by deforming the blank A′ into the configuration shown in FIG. 1 wherein the rod 34 is slidably disposed within the slot 20, and with the first elongate member 24 overlying the second elongate member 36. When the first and second members 24 and 36 are so disposed, the teeth 38 extend upwardly through the apertures 26. To facilitate the formation of the blank A′ into the device A as shown in FIG. 1, the slot 20 is preferably of L shape and includes a first transverse slot portion 20*a* that extends inwardly from a longitudinal edge of the leg 18 to communicate with a longitudinal second slot portion 20*b*, as can be seen in FIG. 1. Due to the L shape of the slot 20, the rod 34 may be easily inserted into or removed from the slot.

When the blank A′ is deformed to provide the first form of the device A as shown in FIG. 1, it will be seen that the first and second lugs 40 and 46 are in abutting contact and serve to reinforce the intermediate section B to the extent that the first and second handle portions 14 and 30 will not move inwardly into contact with one another when the latter are grasped by the hand of a user (not shown).

When it is desired to removably support the cylindrical roller E on the first form A of the device, pressure is exerted on the protuberance 30*a* to pivot the second section D to the position illustrated in phantom line in FIG. 2, whereupon the roller E in the form of a cylindrical shell may be inserted between the first and second members 24 and 30, and as pressure is released from the protuberance 30*a* the resilience of the material defining the first form A of the invention will cause it to return to the position shown in FIG. 3. The first form A of the device as it returns to the first position shown in FIG. 3 grips the cylindrical shell E between the first and second elongate members 24 and 30, with the teeth 38 extending through the apertures 26. Also when the cylindrical shell E is so disposed on the first form A of the device it will be noted that the tang 28 is situated within the confines of the cylindrical shell E and is in pressure contact with the interior surface thereof to assist in maintaining the shell in a fixed position on the invention.

An alternate form A of the invention is shown in FIG. 4 which is identical to the form A or the invention shown in FIG. 1, other than each of the teeth 38 is defined by a single prong. The teeth 38 (FIG. 4) are in far greater number than the teeth shown in FIG. 2. Should it be desired, the cylindrical shell E may be modified by forming a single elongate slot (not shown) in the wall thereof, in lieu of the numerous openings E-1 illustrated in FIG. 4. When the single slot is provided in the shell E, the teeth 30*a* may be extended upwardly therethrough when the shell is supported between the first and second elongate members 24 and 36, and tang 28 is in contact with the interior surface of shell E. Although the slot 20 is illustrated in the drawings as being of L shape, a single longitudinal slot may be used in lieu thereof, providing the longitudinal slot is a sufficient length and width as to permit the second elongate member 36 and teeth 38 to be extended therethrough, when the blank A′ is deformed to define the invention shown in FIGS. 1 and 4.

The use and operation of the invention has been previously explained in detail and need not be repeated.

I claim:

1. A one-piece device formed from a rigid but deformable polymerized resin that may be selectively used as a comb on a woman's hair during drying of the latter in a stream of warmed air, or as a support for a cylindrical shell that has a plurality of longitudinally spaced openings formed therein and about which shell said air may be wound at a desired stage in the drying of the hair, said device comprising:

a. an elongate body of said resin that includes an arcuate intermediate section which has first and second ends, and from which first and second ends, first and second elongate sections project; said first section including a first handle portion adjacent said first end, said first handle portion having a first extremity; a leg that extends outwardly at an angle from said first extremity, said leg having an elongate slot formed therein, and said leg having a first outer end;

b. a first elongate member that extends outwardly from said first outer end, said first member having a plurality of longitudinally spaced apertures formed therein that are on the same spacing as said openings;

c. an angularly disposed tang supported from the free end of said first member; said second section including a second handle portion adjacent said second end, said second handle portion having a first extremity;

d. a rod that projects from said first extremity of said second handle portion;

e. a second elongate member supported by said rod;

f. a plurality of teeth that project outwardly from said second member and are on the same longitudinal spacing as said apertures and extend outwardly therethrough when said body is deformed to dispose said rod in said slot with said first and Second portions being substantially parallel to one another and said first member overlies said second member, with said device when so disposed adapted to be used as a comb, and said device being adapted to be used to removably support said shell when the latter is gripped between said first and second members with said teeth extending through said openings therein and said tang pressure-contacting the interior surface of said shell to assist in holding said shell in a fixed position on said device.

2. A device as defined in claim 1 which further includes an outwardly extending protuberance on said second handle portion adjacent said rod, said protuberance when pressed inwardly moving said second member away from said first member to the extent said teeth are disengaged from said apertures and openings to permit said cylindrical shell to be mounted on or removed from said device.

3. A device as defined in claim 1 wherein each of said teeth is defined by a plurality of spaced parallel elongate rigid elements to obtain maximum combing contact with said hair.

4. A device as defined in claim 1 which further includes a plurality of spaced lugs on the surface of said intermediate section that is interiorly positioned when said rod is disposed in said slot, said lugs cooperating to prevent said intermediate section from collapsing when said first and second handle portions are parallel to one another and gripped by a user.

5. A device as defined in claim 1 wherein said slot is L-shaped, with said slot having a first end thereof defined in an edge of said leg to permit said rod to be easily moved into and out of said slot.

6. A device as defined in claim 3 wherein there are at least four of said teeth.

* * * * *